US009181511B2

(12) United States Patent
Elvidge et al.

(10) Patent No.: US 9,181,511 B2
(45) Date of Patent: Nov. 10, 2015

(54) LUBRICATING OIL COMPOSITION

(75) Inventors: Benjamin R. Elvidge, Oxford (GB); Nancy Z. Diggs, Westfield, NJ (US); Neal J. Milne, Ramsbury (GB); Nigel A. Male, Salisbury (GB)

(73) Assignee: INFINEUM INTERNATIONAL LIMITED (GB)

( * ) Notice: Subject to any disclaimer, the term of this patent is extended or adjusted under 35 U.S.C. 154(b) by 1287 days.

(21) Appl. No.: 12/416,198

(22) Filed: Apr. 1, 2009

(65) Prior Publication Data

US 2010/0256029 A1 Oct. 7, 2010

(51) Int. Cl.

| | |
|---|---|
| ***C10M 135/18*** | (2006.01) |
| ***C10M 135/34*** | (2006.01) |
| ***C10M 135/04*** | (2006.01) |
| ***C10M 135/02*** | (2006.01) |
| ***C07F 7/22*** | (2006.01) |
| ***C10M 141/10*** | (2006.01) |
| ***C10M 141/12*** | (2006.01) |

(52) U.S. Cl.

CPC ..... *C10M 141/10* (2013.01); *C10M 141/12* (2013.01); *C10M 2203/1006* (2013.01); *C10M 2203/1025* (2013.01); *C10M 2207/024* (2013.01); *C10M 2207/026* (2013.01); *C10M 2207/281* (2013.01); *C10M 2207/283* (2013.01); *C10M 2207/289* (2013.01); *C10M 2215/042* (2013.01); *C10M 2215/06* (2013.01); *C10M 2215/064* (2013.01); *C10M 2215/066* (2013.01); *C10M 2219/024* (2013.01); *C10M 2219/046* (2013.01); *C10M 2219/062* (2013.01); *C10M 2219/068* (2013.01); *C10M 2219/082* (2013.01); *C10M 2219/083* (2013.01); *C10M 2219/084* (2013.01); *C10M 2219/085* (2013.01); *C10M 2219/102* (2013.01); *C10M 2219/106* (2013.01); *C10M 2219/108* (2013.01); *C10M 2223/045* (2013.01); *C10N 2220/026* (2013.01); *C10N 2230/04* (2013.01); *C10N 2230/06* (2013.01); *C10N 2230/10* (2013.01); *C10N 2230/12* (2013.01); *C10N 2230/36* (2013.01); *C10N 2230/40* (2013.01); *C10N 2230/42* (2013.01); *C10N 2230/43* (2013.01); *C10N 2230/44* (2013.01); *C10N 2230/45* (2013.01); *C10N 2230/52* (2013.01); *C10N 2230/70* (2013.01); *C10N 2240/10* (2013.01)

(58) Field of Classification Search

CPC ..... C10M 2219/10; C10M 2219/022; C10N 2210/02

USPC ..... 508/300, 322, 331, 382, 299, 302

See application file for complete search history.

(56) References Cited

U.S. PATENT DOCUMENTS

| | | | | |
|---|---|---|---|---|
| 4,664,825 | A | 5/1987 | Walsh | |
| 5,840,672 | A | 11/1998 | Gatto | |
| 6,063,741 | A | 5/2000 | Naitoh et al. | |
| 2004/0171500 | A1 * | 9/2004 | Morita | 508/192 |
| 2006/0205615 | A1 * | 9/2006 | Esche | 508/418 |

FOREIGN PATENT DOCUMENTS

| | | | |
|---|---|---|---|
| EP | 1728848 | A1 | 12/2006 |
| WO | WO-2007120712 | A2 | 10/2007 |

OTHER PUBLICATIONS

Edmund W. Lucas: Chapter 8: Animal and Vegetable Fats, Oils and Waxes, Riegel's Handbook of Industrial Chemistry, Kluwer, NL: XP002581521, table 8.2, p. 250.

Farng, Liehpao Oscar: "8.2.1.2 Sulfurized Esters and Sulfurized Oils", In: Rudnick, Leslie R.: "Lubricant Additives: Chemistry and Applications—Second Edition" Apr. 24, 2009.

* cited by examiner

*Primary Examiner* — Vishal Vasisth

(57) ABSTRACT

The present invention relates to lubricating oil compositions comprising sulfurised esters that exhibit good antioxidancy performance whilst maintaining nitrile elastomer seal compatibility

9 Claims, No Drawings

LUBRICATING OIL COMPOSITION

The present invention relates to lubricating oil compositions, in particular to lubricating oil compositions for automotive engines that exhibit good antioxidancy performance whilst maintaining nitrile elastomer seal compatibility and good copper corrosion performance.

BACKGROUND OF THE INVENTION

Lubricating oil compositions for automotive engines have evolved over the years to include a variety of additives to enhance performance. In recent years environmental concerns have lead to ever stricter limits on chemical emissions whilst consumer pressure leads to ever more demanding performance requirements.

There are many types of lubricating oil composition additives used to enhance engine performance. Whilst a particular additive may exhibit benefits in one aspect of engine performance that same additive may also exhibit detrimental effects in another aspect.

One of the most effective antioxidant and antiwear agents, from both a performance and cost-effectiveness standpoint, used conventionally in lubricating oil compositions for internal combustion engines comprises dihydrocarbyl dithiophosphate metal salts. The metal may be an alkali or alkaline earth metal, or zinc, aluminum, lead, tin, molybdenum, manganese, nickel or copper. Of these, zinc salts of dihydrocarbyl dithiophosphate (ZDDP) are most commonly used. While such compounds are particularly effective antioxidants and antiwear agents such compounds introduce phosphonis, sulfur and ash into the engine that can contribute to deleterious exhaust emissions. Thus levels of phosphorous, sulfur and ash in a lubricating oil composition are now strictly controlled in order to reduce environmental impact. In particular, dihydrocarbyl dithiophosphate metal salts contribute significantly towards the phosphorous content of a lubricating oil composition.

In order to reduce the phosphorous content of a lubricating oil composition it is usual to limit the amount of dihydrocarbyl dithiophosphate metal salts in the lubricant. However, it is proving difficult to reduce the amount of dihydrocarbyl dithiophosphate metal salts in lubricating oil compositions without causing an unacceptable reduction in engine performance.

In the past sulfur containing compounds were considered for their antioxidancy properties, but were not favoured over dihydrocarbyl dithiophosphate metal salts due to the sulfur content and their association with copper corrosion and poor nitrile elastomer seals compatibility.

U.S. Pat. No. 5,840,672 discloses an antioxidant system for a fully formulated lubricant comprising a sulfur containing compound which is stated to exhibit excellent nitrile elastomer seals compatibility. The antioxidant composition comprises a combination of (A) a secondary diarylamine, (B) at least one sulfurised olefin and or sulfurised hindered phenol and (C) at least one molybdenum compound. Typically, the molybdenum compound is present in an amount sufficient to provide the lubricating oil composition with from 60 to 1000 ppm of molybdenum. U.S. Pat. No. 5,840,672 postulates that the sulfur containing compound can be used in the composition without detrimental effect on the nitrile elastomer seals. It is clear from the disclosure of U.S. Pat. No. 5,840,672 that the combination of all three elements of this composition is essential in order to achieve the antioxidancy performance without the detrimental nitrile seals performance. It would seem that the molybdenum compound is acting as a sulfur scavenger in the composition of U.S. Pat. No. 5,840,672 and thus controlling the amount of active sulfur present in the lubricant and thereby the nitrile seals performance.

It is an object of preferred embodiments of the present invention to provide an alternative means of attaining antioxidancy performance without detriment to nitrile seals performance and without causing metal corrosion.

SUMMARY OF THE INVENTION

In accordance with the present invention there is provided a lubricating oil composition comprising a major amount of an oil of lubricating viscosity and minor amounts of:

(a) a sulfurised ester, (b) a primary antioxidant, (c) a dihydrocarbyl dithiophosphate metal salt, and (d) an oil soluble organomolybdenum compound, providing no more than 50 ppm of molybdenum to the composition.

Unless otherwise stated, all amounts of additives are reported in mass % on an active ingredient ("a.i.") basis, i.e., independent of the diluent or carrier oil.

Sulfurised Ester

The sulfurised ester of the present application is suitably a sulfurised olefin ester.

Preferably, the sulfurised ester is a sulfurised fatty acid ester. The sulfurised fatty acid ester may be derived from any suitable fatty acid, but is preferably a vegetable oil fatty acid, such as, but not limited to, palm oil, tallow oil, corn oil, grapeseed oil, coconut oil, cottonseed oil, wheatgerm oil, soya oil, safflower oil, olive oil, peanut oil, rapeseed oil and sunflower oil. The sulfurised fatty acid ester is preferably derived from palm oil, soya oil or tallow oil or a mixture of palm oil, soya oil and tallow oil. The sulfurised fatty acid ester suitably comprises substantially only fatty acid ester and no other sulfurised carboxylic acid ester.

Suitably, the fatty acid ester has an olefinic content of at least about 40 mass %, preferably at least about 50 mass %, and more preferably at least about 55 mass %. The fatty acid ester may have an olefinic content of up to 100 mass %. Alternatively, the fatty acid ester may have an olefinic content of no more than about 95 mass %, or no more than about 90 mass %, or no more than about 85 mass %. Suitably, the fatty acid ester has an olefinic content of from about 40 mass % to about 95 mass %, preferably from about 50 mass % to about 90 mass %, and more preferably from about 55 mass % to about 80 mass %.

Suitable sulfurised esters are available commercially and examples of suitable esters include Dover Chemical's Base 10SE, Additin 4412F, Additin RC 2310 or Additin RC2410 all from Rhein Chemie, and Esterol 10SX from Arkema.

Methods of making sulfurised materials are well known. A suitable method, by way of example, is described in Lubricant Additives: Chemistry and Applications, Ed. Leslie R Rudnick, Chapter 9 (Sulfur Carriers—T. Rossrucker and A Fessenbecker), CPC Press 2003.

Preferably, the sulfurised ester is made by a method which includes subjecting the ester to sparging with a nitrogen and/or nitrogen and oxygen gas mixture at elevated temperature.

The sulfur content of the sulfurised ester is important since it is the sulfur that provides the antioxidancy but also the deleterious effects of metal corrosion and nitrile seal degradation. In addition, industry standards limit the total amount of sulfur that may be present in an automotive engine lubricating oil composition.

The amount of sulfur provided to the lubricating oil composition by the sulfurised ester will depend upon the sulfur content of the sulfurised ester and the amount of sulfurised ester added to the composition.

Thus, the sulfurised ester suitably provides the lubricating oil composition with at least about 0.05mass %, preferably 0.1 mass % and more preferably at least about 0.15 mass % sulfur. Suitably, the sulfurised ester provides the lubricating oil composition with no more than about 0.3 mass %, preferably no more than about 0.25 mass % and more preferably no more than about 0.2 mass % sulfur. Suitably, the sulfurised ester provides the lubricating oil composition with from about 0.05 mass % to about 0.3 mass % sulfur.

The sulfur content of the sulfurised ester is suitably at least about 5 mass %, preferably at least about 7 mass % and more preferably at least about 9 mass % sulfur. The sulfur content of the sulfurised ester is suitably no more then about 20 mass %, preferably no more than about 15 mass % and more preferably no more than about 12 mass % sulfur. Suitably, the sulfurised ester contains from about 5 mass % to about 20 mass % sulfur. Preferably, the sulfurised ester contains from about 9 mass % to about 15 mass % sulfur.

Suitably, the sulfurised ester comprises sulfur bridging groups. The sulfurised ester may comprise sulfur bridging groups comprising from 1 to 8 sulfur atoms. Alternatively, or in addition, the sulfurised ester may comprise sulfur bridging groups comprising one or more of the group comprising thioether groups, thiacyclopropane groups, thiol, dithiirane, thiophene groups or thiocarbonyl groups.

Examples of suitable sulfurised esters are shown below as Formulas 1 to 7 wherein m=1 to 8 and n=0 to 18. $R^1$ groups are such that the total backbone chain, with intervening methylene groups and sulfur-bound carbon atoms to the carbonyl group, are $C_{12}$-$C_{24}$. $R^3$ groups are such that the total backbone chain, with intervening methylene groups and sulfur-bound carbon atoms to the carbonyl group, are $C_{12}$-$C_{24}$. $R^2$ and $R^4$ groups may be H or hydrocarbyl groups (as defined below). $R^5$ may be H or hydrocarbyl groups (as defined below).

Formula 1

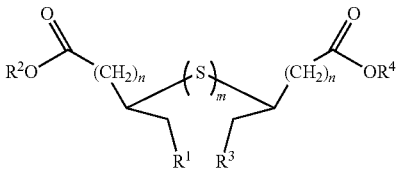

Formula 2

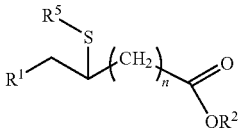

Formula 3

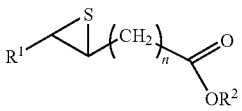

Formula 4

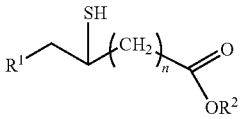

-continued

Formula 5

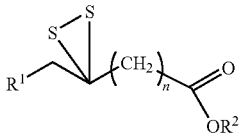

Formula 6

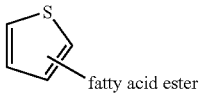

Formula 7

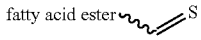

Suitably, the major component of the sulfurised ester has a structure where m>2, for example m=3 to 8. Suitably, n=0 to 12, preferably n=0 to 10, more preferably n=0 to 8. Advantageously, the majority of the ester comprises a molecule where n=7.

Antioxidants

Antioxidants reduce the tendency of base stocks to deteriorate in service which deterioration can be evidenced by the products of oxidation such as sludge and varnish-like deposits on the metal surfaces and by viscosity growth.

Antioxidants can be divided into two groups by functionality, namely primary and secondary antioxidants. Primary antioxidants are free radical scavenging antioxidants, which inhibit oxidation via chain terminating reactions. They have reactive OH or NH groups and inhibition occurs via a transfer of a proton to the free radical species. The resulting radical is stable and does not abstract a proton from the polymer chain.

Examples of suitable primary antioxidants include, hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and napthylamines, phosphorous esters, metal thiocarbamates, ashless thiocarbamates and oil soluble copper compounds as described in U.S. Pat. No. 4,867,890. The primary antioxidant of the present invention is suitably one or a mixture of the group comprising aromatic amines, hindered phenols, hindered bisphenols, dialkyldithiocarbamates and phenothiazines. Preferably, the primary antioxidant is one or a mixture of an aromatic amine and a hindered phenol, in particular one or more of the group comprising diarylamines, phenylenediamines and hindered phenols. Most preferred are the dialkyl substituted diphenylamines, wherein the alkyl is $C_4$-$C_{20}$, such as dinonyl diphenylamine and the hindered phenols, such as isooctyl-3,5-di-tert-butyl-4-hydroxycinnamate and mixtures of same.

Secondary antioxidants are frequently referred to as hydroperoxide decomposers, because they decompose hydroperoxides into non-radical, non-reactive, and thermally stable products. They are often used in combination with primary antioxidants to yield synergistic stabilization effects. Hydroperoxide decomposers prevent the split of hydroperoxides into extremely reactive alkoxy and hydroxy radicals. Examples of suitable secondary antioxidants include organophosphorus compounds, including trivalent phosphorus compounds such as, phosphites and phosphonites, thioethers and molybdenum dithiocarbamates, for example.

Suitably, the primary antioxidant is substantially free of sulfur.

In formulations according to the present invention the primary antioxidant is suitably present in amount of from about 0.1 to about 5.0 mass %, preferably from about 0.25 to about 2.0 mass %, and more preferably from about 0.5 to about 1.5 mass %.

Dihydrocarbyl Dithiophosphate Metal Salts

The dihydrocarbyl dithiophosphates of the present invention are oil soluble salts of dihydrocarbyl dithiophosphoric acids and may be represented by the following formula:

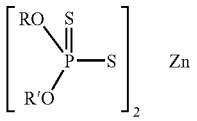

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be 5 or greater. The zinc dihydrocarbyl dithiophosphate (ZDDP) can therefore comprise zinc dialkyl dithiophosphates. ZDDP is the most commonly used antioxidant/antiwear agent in lubricating oil compositions for internal combustion engines, and in conventional passenger car diesel engines formulated to meet present European ACEA specifications. Whilst the zinc dihydrocarbyl dithiophosphate is exemplified above, other metal salts of dihydrocarbyl dithiophosphates may be used.

The lubricating oil compositions of the present invention suitably contain an amount of ZDDP (or other dihydrocarbyl dithiophosphate metal salt) that introduces at least about 0.01 mass %, preferably at least about 0.02 mass % and more preferably at least about 0.04 mass % phosphorous. Suitably, the dihydrocarbyl dithiophosphate metal salt provides no more than about 0.12 mass %, such as no more than about 0.1 mass %, preferably no more than about 0.09 mass % and most preferably, no more than about 0.08 mass % phosphorous. Suitably the dihydrocarbyl dithiophosphate metal salt provides from about 0.01 to about 0.1 mass %, preferably from about 0.02 to about 0.09 mass % and more preferably from about 0.04mass % to about 0.08 mass % of phosphorus into the lubricating oil composition. The phosphorus content of the lubricating oil compositions is determined in accordance with the procedures of ASTM D5185.

Molybdenum Compound

Lubricating oil compositions of the present invention may optionally comprise a small quantity of one or more oil soluble organo-molybdenum compounds. Although organo-molybdenum additives have some antioxidancy functionality, the combination of the organo-molybdenum compound with the sulfurised ester, the primary antioxidant and the dihydrocarbyl dithiophosphate metal salt in the present invention means that the organo-molybdenum compound can function primarily as an antiwear additive. Since the organo-molybdenum compound is acting primarily as an antiwear additive and no antioxidancy performance is required, the amount of molybdenum required to be provided by the organo-molybdenum compound is relatively low.

Suitably, the organo-molybdenum compound is present in an amount that provides the lubricating oil composition with no more than 50 ppm molybdenum, and preferably no more than 40 ppm molybdenum. Whilst the present invention does not require any organo-molybdenum compound to achieve acceptable antioxidancy performance, and thus the composition may comprise no molybdenum, some molybdenum may be beneficial for wear performance and thus the lubricating oil composition of the present invention may comprise at least 2 ppm, preferably at least 5 ppm of molybdenum. Suitably, the organo-molybdenum compound is present in an amount to provide from about 0 to about 50 ppm molybdenum, preferably from about 2 to about 40 ppm molybdenum to the lubricating oil composition. These values are based upon the weight of the lubricating oil composition.

For the lubricating oil compositions of this invention, any suitable oil soluble organo-molybdenum compound may be employed. Preferably, dimeric and trimeric molybdenum compounds are used. Examples of such oil soluble organo-molybdenum compounds are the dialkyldithiocarbamates, dialkyldithiophosphates, dialkyldithiophosphinates, xanthates, thioxanthates, carboxylates and the like, and mixtures thereof. Particularly preferred are molybdenum dialkylthiocarbamates.

A suitable dimeric molybdenum dialkyldithiocarbamate for use as an additive in the present invention is a compound expressed by the following formula:

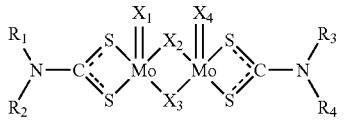

$R_1$ through $R_4$ independently denote a straight chain, branched chain or aromatic hydrocarbyl group; and $X_1$ through $X_4$ independently denote an oxygen atom or a sulfur atom. The four hydrocarbyl groups, $R_1$ through $R_4$, may be identical or different from one another.

Another group of organo-molybdenum compounds useful in the lubricating compositions of this invention are trinuclear (trimeric) molybdenum compounds, especially those of the formula $Mo_3S_kL_nQ_7$ and mixtures thereof wherein the L are independently selected ligands having organo groups with a sufficient number of carbon atoms to render the compound soluble in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are selected from the group consisting of

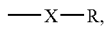

1

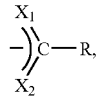

2

-continued

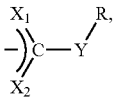

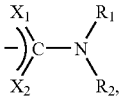

and

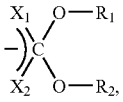

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" as used throughout this specification denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Importantly, the organo groups of the ligands have a sufficient number of carbon atoms to render the compound soluble in the oil. For example, the number of carbon atoms in each group will generally range between 1 to about 100, preferably from 1 to 30, and more preferably between 4 to 20. Preferred ligands include dialkyldithiophosphate, alkylxanthate, carboxylates, dialkyldithiocarbamate, and mixtures thereof. Most preferred are the dialkyldithiocarbamates. Those skilled in the art will realize that formation of the compounds requires selection of ligands having the appropriate charge to balance the core's charge (as discussed below).

Compounds having the formula $Mo_3S_kL_nQ_z$ have cationic cores surrounded by anionic ligands, wherein the cationic cores are represented by structures such as

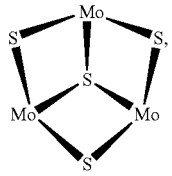

and

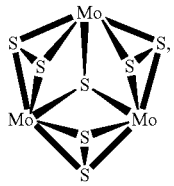

which have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate, i.e., having multiple connections to one or more cores. It is believed that oxygen and/or selenium may be substituted for sulfur in the core(s).

Oil-soluble trinuclear molybdenum compounds are preferred and can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble trinuclear molybdenum compounds can be formed during a reaction in the appropriate solvent(s) of a molybdenum source such as $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble trinuclear molybdenum compound. The appropriate liquid/solvent may be, for example, aqueous or organic.

The ligand chosen must have a sufficient number of carbon atoms to render the compound soluble in the lubricating composition. The term "oil-soluble" as used herein does not necessarily indicate that the compounds or additives are soluble in the oil in all proportions. It does mean that they are soluble in use, transportation, and storage.

A sulfurized molybdenum containing composition prepared by (i) reacting an acidic molybdenum compound and a basic nitrogen compound selected from the group consisting of succinimide, a carboxylic acid amide, a hydrocarbyl monoamine, a phosphoramide, a thiophosphoramide, a Mannich base, a dispersant viscosity index improver, or a mixture thereof, in the presence of a polar promoter, to form a molybdenum complex (ii) reacting the molybdenum complex with a sulfur containing compound, to thereby form a sulfur and molybdenum containing composition is useful within the context of this invention. The sulfurized molybdenum containing compositions may be generally characterized as a molybdenum/sulfur complex of a basic nitrogen compound. The precise molecular formula of these molybdenum compositions is not known with certainty. However, they are believed to be compounds in which molybdenum, whose valences are satisfied with atoms of oxygen or sulfur, is either complexed by, or the salt of one or more nitrogen atoms of the basic nitrogen containing compound used in the preparation of these compositions.

Oil of Lubricating Viscosity

The oil of lubricating viscosity may be selected from Group I, II, III or IV base stocks, synthetic ester base stocks or mixtures thereof. The base stock groups are defined in the American Petroleum Institute (API) publication "Engine Oil Licensing and Certification System", Industry Services Department, Fourteenth Edition, December 1996, Addendum 1, December 1998. The base stock will have a viscosity preferably of 3-12, more preferably 4-10, most preferably 4.5-8 $mm^2/s$ (cSt.) at 100° C.

(a) Group I mineral oil base stocks contain less than 90% saturates and/or greater than 0.03% sulfur and have a viscosity index greater than or equal to 80 and less than 120, measured using the test methods specified in Table A below.

(b) Group II mineral oil base stocks contain greater than or equal to 90% saturates and less than or equal to 0.03% sulfur and have a viscosity index greater than or equal to 80 and less than 120 using the test methods specified in Table A below.

(c) Group III mineral oil base stocks contain greater than or equal to 90% saturates and less than or equal to 0.03% sulfur and have a viscosity index greater than or equal to 120 using the test methods specified in Table A below.

(d) Group IV base stocks are polyalphaolefins (PAO).

(e) Suitable ester base stocks that can be used comprise the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol 2-ethylhexyl alcohol, ethylene glycol, diethylene glycol monoether, propylene glycol, etc.) Specific examples of these esters include dibutyl adipate, di(e-ethylhexyl) sebacate, din-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic base stock oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4294, D4927, or D3120 |

Whilst it is recognized that the lubricating oil composition of the present invention may comprise some Group I base stock as a carrier oil or diluent of one or more of the additives, the oil of lubricating viscosity preferably comprises substantially no Group I base stock oil.

Lubricating oil compositions according to the present invention may additionally comprise one or more other conventional additives, including, but not limited to dispersants, detergents, supplemental antioxidants, friction modifiers, pour point depressants, viscosity index improvers, friction modifiers, corrosion inhibitors, antifoamants and the like.

Dispersant

Dispersants useful in the context of the present invention include the range of nitrogen-containing, ashless (metal-free) dispersants known to be effective to reduce formation of deposits upon use in gasoline and diesel engines, when added to lubricating oils. The ashless, dispersants useful for the present invention suitably comprise an oil soluble polymeric long chain backbone having functional groups capable of associating with particles to be dispersed. Typically, such dispersants have amine, amine-alcohol or amide polar moieties attached to the polymer backbone, often via a bridging group. A suitable ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

A dispersant suitable for lubricating oil compositions of the present invention may be derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5 functional groups (mono- or dicarboxylic acid producing moieties) per polyalkenyl moiety (a medium functionality dispersant). Functionality (F) can be determined according to the following formula:

$$F=(SAP\times M_n)/((112{,}200\times \text{A.I.})-(SAP\times \text{MW})) \quad (1)$$

wherein SAP is the saponification number (i.e., the number of milligrams of KOH consumed in the complete neutralization of the acid groups in one gram of the reaction product, as determined according to ASTM D94); $M_n$ is the number average molecular weight of the starting olefin polymer; A.I. is the percent active ingredient of the reaction product (the remainder being unreacted olefin polymer, carboxylic acid, anhydride or ester and diluent); and MW is the molecular weight of the carboxylic acid, anhydride or ester (e.g., 98 for succinic anhydride).

Generally, each mono- or dicarboxylic acid-producing moiety will react with a nucleophilic group (amine, alcohol, amide or ester polar moieties) and the number of functional groups in the polyalkenyl-substituted carboxylic acylating agent will determine the number of nucleophilic groups in the finished dispersant.

The polyalkenyl moiety of the dispersant of the present invention has a number average molecular weight of at least 900, suitably at least 1500, preferably between 1800 and 3000, such as between 2000 and 2800, more preferably from 2100 to 2500, and most preferably from 2200 to 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The polyalkenyl moiety suitable for forming a dispersant useful in a composition of the present invention preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from 1.5 to 2.1, preferably from 1.6 to 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms Another useful class of polymers is polymers prepared by cationic polymerization of isobutene, styrene, and the like. Common polymers from this class include polyisobutenes obtained by polymerization of a $C_4$ refinery stream having a butene content of 35 to 75% by wt., and an isobutene content of 30 to 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HRPIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 1500 to 3000. Methods for making polyisobutylene are known, Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for 0.5 to 10 hours preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually 180° C to 235° C., for 0.5 to 10 hours, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

Monounsaturated reactants that may be used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C=C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from equimolar amount to 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nucleophilic reactant, such as an amine, amino-alcohol, alcohol, metal compound, or mixture thereof, to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitrites, imidazoline groups, and the like. Particularly useful amine compounds include mono- and polyamines, e.g., polyalkene and polyoxyalkylene polyamines of 2 to 60, such as 2 to 40 (e.g., 3 to 20) total carbon atoms having 1 to 12, such as 3 to 12, preferably 3 to 9, most preferably form 6 to 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl)cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris(hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

The functionalized, oil-soluble polymeric hydrocarbon backbones may also be derivatized with hydroxy compounds such as monohydric and polyhydric alcohols, or with aromatic compounds such as phenols and naphthols. Preferred polyhydric alcohols include alkylene glycols in which the alkylene radical contains from 2 to 8 carbon atoms. Other useful polyhydric alcohols include glycerol, mono-oleate of glycerol, monostearate of glycerol, monomethyl ether of glycerol, pentaerythritol, dipentaerythritol, and mixtures thereof. An ester dispersant may also be derived from unsaturated alcohols, such as allyl alcohol, cinnamyl alcohol, propargyl alcohol, 1-cyclohexane-3-ol, and oleyl alcohol. Still other classes of alcohols capable of yielding ashless dispersants comprise ether-alcohols, including oxy-alkylene and oxy-arylene. Such ether-alcohols are exemplified by ether-alcohols having up to 150 oxy-alkylene radicals in which the alkylene radical contains from 1 to 8 carbon atoms. The ester dispersants may be di-esters of succinic acids or acid-esters, i.e., partially esterified succinic acids, as well as partially esterified polyhydric alcohols or phenols, i.e., esters having free alcohols or phenolic hydroxy radicals. An ester dispersant may be prepared by any one of several known methods as described, for example, in U.S. Pat. No. 3,381,022.

Another class of high molecular weight ashless dispersants comprises Mannich base condensation products. Generally, these products are prepared by condensing one mole of a long chain alkyl-substituted mono- or polyhydroxy benzene with 1 to 2.5 moles of carbonyl compound(s) (e.g., formaldehyde and paraformaldehyde) and 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

Dispersant(s) suitable for use in lubricating oil composition of the present invention are preferably non-polymeric (e.g., are mono- or bis-succinimides).

Dispersant(s) used in lubricating oil compositions of the present invention may be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from 0.1 to 20 atomic proportions of boron for each mole of acylated nitrogen composition.

The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding a sufficient quantity of a boron compound, preferably boric acid, usually as a slurry, to the acyl nitrogen compound and heating with stirring at from 135° C. to 190° C., e.g., 140° C. to 170° C., for from 1 to 5 hours, followed by nitrogen stripping. Alternatively, the boron treatment can be conducted by adding boric acid to a hot reaction mixture of the dicarboxylic acid material and amine, while removing water. Other post reaction processes known in the art can also be applied.

If a borated dispersant is present in a lubricating oil composition according to the present invention, the amount of boron provided to the lubricating oil composition by the borated dispersant is suitably less than 80 ppm, preferably no more than 70 ppm.

Detergent

Lubricating oil compositions of the present invention may comprise a neutral or overbased metal-containing lubricating oil detergent These metal detergents may be present in such amounts to provide their normal attendant functions so long as the sulfated ash content of the oil remains below the required level, and generally are used in amounts of from 0.5 to 3 mass %.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80 mg KOH/g. It is possible to include large amounts of a metal base by reacting an excess of a metal compound, such as an oxide or hydroxide, with an acid gas such as carbon dioxide. The resulting overbased detergent comprises neutralized detergent as the outer layer of a metal base (e.g., carbonate) micelle. Such overbased detergents may have a TBN of 150 mg KOH/g or greater and overbased detergents typically used have a TBN from 250 to 450 mg KOH/g or more.

Detergents that are conventionally employed include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. The alkaryl sulfonates usually contain from 9 to 80 or more carbon atoms, preferably from 16 to 60 carbon atoms per alkyl substituted aromatic moiety.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oilsoluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility. Calcium alkyl salicylate detergents are preferred for use in the present invention.

Friction Modifiers

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acids as exemplified by glycerol oleate, which is preferred, aliphatic carboxylic ester-amides, aliphatic phosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Typically, the friction modifier makes up 0.02 to 2.0 mass % of the lubricating oil composition. Preferably, from 0.05 to 1.0 mass %, more preferably from 0.1 to 0.5 mass % of the friction modifier is used.

Lubricating Oil Flow Improver

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like. These may be used in amounts of from 0.01 to 5.0 mass %, preferably 0.1 to 3.0 mass %. They are preferably used when mineral oil base stocks are employed but are not required when the base stock is a PAO or synthetic ester.

Viscosity Modifier

The viscosity modifier (VM) functions to impart high and low temperature operability to a lubricating oil. The VM used may have that sole function, or may be multifunctional. It may be present in amounts of from 0.01 to 20.0 mass %, preferably 1.0 to 10.0 mass %.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Antifoamants

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. The invention comprising the product results from the admixture of the additive components to form a lubricating oil composition.

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least 100° C. Thereafter, the premix is cooled to at least 85° C. and the additional components are added.

When forming a concentrate containing multiple additives, it may be preferable to include an additive that maintains the stability of the viscosity of the blended additives. Thus, although polar group-containing additives achieve a suitably low viscosity in the pre-blending stage it has been observed that some compositions increase in viscosity when stored for prolonged periods. Additives effective in controlling this viscosity increase include the long chain hydrocarbons functionalized by reaction with mono- or dicarboxylic acids, anhydrides or esters, which are used in the preparation of the ashless dispersants as hereinbefore disclosed.

The final crankcase lubricating oil formulation may employ from 2 to 20 mass %, preferably 4 to 18 mass %, and most preferably 5 to 17 mass % of the concentrate or additive package, with the remainder being base stock.

EXAMPLES

The present invention will be further illustrated, by way of example only, with reference to the following examples.

Example 1

The formulations set out in Table 1, were subjected to the IIIG engine test according to the method ASTM D3720-07 Standard Test Method for Evaluation of Automotive Engine Oils in the Sequence IIIG, Spark-Ignition Engine. Viscosity increase and valve wear were measured.

The sulfurised fatty acid ester used in the examples was Dover Chemical's Base 10SE. The quoted amounts are in mass % active ingredient.

TABLE 1

| Additive | Test Limit | Oil 1 mass % | Oil 2 mass % |
|---|---|---|---|
| Sulfurised fatty acid ester | | 1.0 | 1.0 |
| Molybdenum Dithiocarbamate | | | 0.009 |
| Dispersant | | 3.300 | 3.300 |
| Calcium Sulphonate Detergent (300BN) | | 1.600 | 1.550 |
| ZDDP | | 0.960 | 0.960 |
| Aminic/hindered phenol antioxidant mixture | | 0.700 | 0.550 |
| Antifoamant | | 0.001 | 0.001 |
| Group II base stock | | 80.585 | 80.734 |
| Group III base stock | | 9.900 | 9.900 |
| Group I base stock | | 0.933 | 0.933 |
| Viscosity modifier | | 1.021 | 1.063 |
| Boron, ppm | | <5 | <5 |
| Molybdenum, ppm | | 0 | 5 |
| Sulphated ash, mass % | | 0.464 | 0.464 |
| Phosphorous, mass % | | 0.077 | 0.077 |
| Sulfur, mass % | | 0.260 | 0.258 |
| Viscosity increase at 100 hours, % | 150% max. | 94.2 | 94.3 |
| Weighted piston deposit merits | 3.5 min. | 4.78 | 3.89 |
| Average Cam and lifter wear | 60 um max. | 16.5 | 23 |
| Hot rings stuck | None | None | None |
| Oil consumption | 4.61 max. | 4.02 | 3.89 |

The test data of Table 1 shows that formulations comprising the sulfurised fatty acid ester pass the IIIG engine test criteria for viscosity increase and wear performance either with or without the presence of molybdenum.

Example 2

The oil specified in Table 2 was subjected to a copper corrosion test, ASTM D130-04e1 Standard Test Method for Corrosiveness to Copper from Petroleum Products by Copper Strip Test. It can be seen that despite the presence of the sulfurised fatty acid ester, the lubricant still passes the copper corrosion test.

TABLE 2

| Additive | Oil 4, mass % |
|---|---|
| Dispersant | 3.20 |
| Calcium sulphate detergent (300BN) | 1.60 |
| ZDDP | 0.96 |
| Aminic antioxidant | 0.50 |
| Sulphurised Ester | 1.04 |
| Molybdenum Dithiocarbamate | 0.10 |
| GMO friction modifier | 0.15 |
| ETA FM | 0.125 |
| Antifoamant | 0.002 |
| Viscosity Modifier | 7.800 |
| Basestock | Balance |
| Phosphorous, mass % | 0.077 |
| Sulfur, mass % | 0.270 |
| Sulphated Ash, mass % | 0.464 |
| Molybdenum, ppm | 55 |
| Boron, ppm | <5 |
| D130 (2B Max.) | 1B |

Example 3

The oils set out in Table 3 were investigated for their compatibility with nitrile seals using the method described in ASTM D7216-05 Standard Test Method for Determining Automotive Engine Oil Compatibility with Typical Seal Elastomers. The performance was measured against the projected GF-5 requirements.

TABLE 3

| Additive | Projected limits | Oil 5, mass % | Oil 6, mass % |
|---|---|---|---|
| Sulphurised ester | | 1.000 | 1.000 |
| Molybdenum dithiocarbamate | | 0.050 | 0.000 |
| Dispersant | | 2.660 | 3.300 |
| Calcium sulphonate detergent (300 BN) | | 1.600 | 1.600 |
| ZDDP | | 0.960 | 0.960 |
| Amininc/hindered phenol antioxidant mixture | | 0.400 | 0.250 |
| Antifoamant | | 0.002 | 0.002 |
| Base stock | | Balance | Balance |
| Sulphated Ash, mass % | | 0.464 | 0.464 |
| Phosphorous, mass % | | 0.077 | 0.077 |
| Sulfur, mass % | | 0.260 | 0.260 |
| Mo, ppm | | 28 | 0 |
| B, ppm | | <5 | <5 |
| HNBR-1: Volume change, % | −5.5 | 0.57 | 0.34 |
| HNBR-1: Hardness change, % | −5.5 | 1 | 0 |
| HNBR-1: Tensile strength change, % | −20.10 | −3.1 | −10 |
| HNBR-1: Elongation change, % | −35.0 | −26.5 | −31.2 |
| HNBR-1: Change in tensile strength at 50% elongation, % | −10.35 | 1.5 | 1.27 |

It can be seen that passing results were achieved with or without molybdenum dithiocarbamate, despite the presence of the sulphurised ester.

What is claimed is:

1. A lubricating oil composition comprising a major amount of an oil of lubricating viscosity and:

(a) a sulfurised fatty acid ester derived from a fatty acid ester of palm oil, soya oil, tallow oil or a mixture of palm oil, soya oil and tallow oil ester having an olefinic content of from about 40 to about 100 mass %, and comprising from about 5 to about 20 mass % sulfur; in an amount providing said lubricating oil composition with from about 0.05 to about 0.3 mass % of sulfur, (b) one or more a primary antioxidants selected from the group consisting of antioxidant is one or more of the group comprising aromatic amines, hindered phenols, hindered bisphenols, dialkyldithiocarbamates and phenothiazines, (c) a dihydrocarbyldithiophosphate metal salt in an amount providing said lubricating oil composition with from about 0.01 to about 0.12 mass % of phosphorus, and (d) an oil soluble organomolybdenum compound, in an amount providing said lubricating oil composition with from about 2 to no more than 50 ppm of molybdenum to the composition.

2. A lubricating oil composition according to claim 1, wherein the sulfurised fatty acid ester has a structure as defined by Formula I:

Formula I

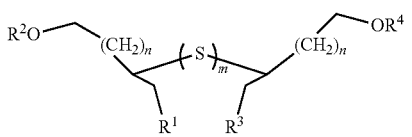

wherein m =1 to 8 and n=0 to 18, $R^1$ and $R^3$ are independently such that the total backbone chain, with intervening methylene groups and sulfur-bound carbon atoms to the carbonyl group are $C_{12}$-$C_{24}$, $R^2$, $R^4$ and $R^5$ groups are independently H or hydrocarbyl groups.

3. A lubricating oil composition according to claim 1, wherein the sulfurised fatty acid ester has a structure as defined by Formula II:

Formula II

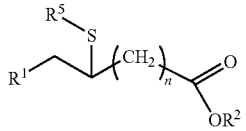

wherein n=0 to 18, $R^1$ is such that the total backbone chain, with intervening methylene groups and sulfur-bound carbon atoms to the carbonyl group is $C_{12}$-$C_{24}$ $R^2$ and $R^5$ groups are independently H or hydrocarbyl groups.

4. A lubricating oil composition according to claim 1, wherein the sulfurised fatty acid ester has a structure according to Formula III:

Formula III

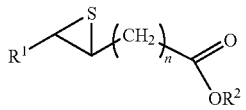

wherein n=0 to 18, $R^1$ is such that the total backbone chain, with intervening methylene groups and sulfur-bound carbon atoms to the carbonyl group is $_{C12}$-$C_{24}$, $R^2$ is H or a hydrocarbyl group.

5. A lubricating oil composition according to claim 1, wherein the sulfurised fatty acid ester has a structure according to Formula IV:

Formula IV

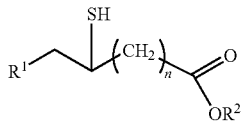

wherein n=0 to 18, $R^1$ is such that the total backbone chain, with intervening methylene groups and sulfur-bound carbon atoms to the carbonyl group is $C_{12}$-$C_{24}$, $R^2$ is H or a hydrocarbyl group.

6. A lubricating oil composition according to claim 1, wherein the sulfurised fatty acid ester has a structure according to Formula V:

Formula V

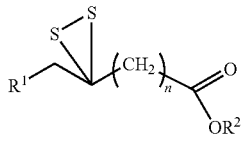

wherein n=0 to 18, R is such that the total backbone chain, with intervening methylene groups and sulfur-bound carbon atoms to the carbonyl group is $C_{12}$-$C_{24}$, $R^2$ is H or a hydrocarbyl group.

7. A lubricating oil composition according to claim 1, wherein the sulfurised fatty acid ester has a structure according to Formula VI:

Formula VI

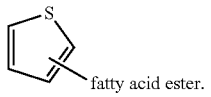

8. A lubricating oil composition according to claim 1, wherein the sulfurised fatty acid ester has a structure according to Formula VII:

fatty acid ester

Formula VII

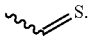

9. A lubricating oil composition according to claim 1, wherein the oil soluble organomolybdenum compound provides from 2 to 40 ppm molybdenum to the composition.

* * * * *

UNITED STATES PATENT AND TRADEMARK OFFICE

CERTIFICATE OF CORRECTION

PATENT NO. : 9,181,511 B2
APPLICATION NO. : 12/416198
DATED : November 10, 2015
INVENTOR(S) : Benjamin R. Elvidge et al.

It is certified that error appears in the above-identified patent and that said Letters Patent is hereby corrected as shown below:

In the Claims

Column 19, line 42 In Claim 1, section (b), first line, after "one or more", remove "a".

Column 19, line 42 In Claim 1, section (b), second line, delete "antioxidants is one or more of the group comprising".

Column 21, line 18 In Claim 8, Formula VII, delete "fatty acid ester 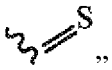 ", and insert -- fatty acid ester 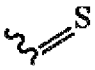 --.

Signed and Sealed this
Fifteenth Day of March, 2016

Michelle K. Lee

Michelle K. Lee
*Director of the United States Patent and Trademark Office*